United States Patent [19]

Emert et al.

[11] Patent Number: 4,734,043

[45] Date of Patent: Mar. 29, 1988

[54] MODULAR JACK

[75] Inventors: Donald R. Emert, Etters; John D. Walden, Mechanicsburg, both of Pa.

[73] Assignee: E. I. Du Pont de Nemours and Company, Wilmington, Del.

[21] Appl. No.: 73,880

[22] Filed: Jul. 14, 1987

Related U.S. Application Data

[63] Continuation of Ser. No. 828,248, Feb. 11, 1986, abandoned.

[51] Int. Cl.[4] ..... H01R 13/04

[52] U.S. Cl. ..... 439/65

[58] Field of Search ..... 439/65, 68, 69, 74, 439/571, 604; 336/192

[56] References Cited

U.S. PATENT DOCUMENTS

| | | | |
|---|---|---|---|
| 1,984,036 | 12/1934 | Schwartzmann | 336/192 |
| 2,979,554 | 4/1961 | Maitland | 174/138 |
| 2,999,962 | 9/1961 | Wahl | 336/192 |
| 3,056,939 | 10/1962 | Rayburn | 339/17 |
| 3,500,288 | 3/1970 | Startin et al. | 339/17 C |
| 3,794,953 | 2/1974 | Malin | 339/17 C |
| 3,815,077 | 6/1974 | Anhalt et al. | 339/17 CF |
| 3,902,777 | 9/1975 | Anhalt et al. | 339/17 C |
| 4,186,988 | 2/1980 | Kobler | 339/176 MP |
| 4,193,654 | 3/1980 | Hughes et al. | 339/17 |
| 4,193,658 | 3/1980 | Dittman et al. | 339/97 P |
| 4,195,900 | 4/1980 | Hughes | 329/125 |
| 4,202,593 | 5/1980 | Abernethy et al. | 339/125 R |
| 4,210,376 | 7/1980 | Hughes et al. | 339/17 LC |
| 4,221,458 | 9/1980 | Hughes et al. | 339/126 R |
| 4,225,209 | 9/1980 | Hughes | 339/126 R |
| 4,231,628 | 11/1980 | Hughes et al. | 339/17 LC |
| 4,257,667 | 3/1981 | Iantorno | 339/221 R |
| 4,261,633 | 4/1981 | Abernethy | 339/97 P |
| 4,269,467 | 5/1981 | Hughes | 339/126 R |
| 4,274,691 | 6/1981 | Abernethy et al. | 339/19 |
| 4,292,736 | 10/1981 | Hughes et al. | 29/884 |
| 4,296,550 | 10/1981 | Kobler | 29/884 |
| 4,296,991 | 10/1981 | Hughes et al. | 339/176 MP |
| 4,315,664 | 2/1982 | Hughes et al. | 339/176 M |
| 4,327,958 | 5/1982 | Hughes et al. | 339/276 SF |
| 4,343,530 | 8/1982 | Leger | 339/220 |
| 4,347,552 | 9/1982 | Pearcy et al. | 339/17 C |
| 4,423,467 | 12/1983 | Shaheen | 361/403 |
| 4,435,031 | 3/1984 | Black et al. | 339/17 C |
| 4,457,570 | 7/1984 | Bogese, II | 339/17 C |

FOREIGN PATENT DOCUMENTS

| | | | |
|---|---|---|---|
| 3522067 | 1/1986 | Fed. Rep. of Germany | 339/17 C |

*Primary Examiner*—Joseph H. McGlynn

[57] ABSTRACT

An electrical connector adapted to be mounted on a circuit board, said connector having at least two legs, each of said legs being adapted to fit snugly into a corresponding hole on said circuit board, each leg having a cross section perpendicular to its long axis which is a closed geometric shape having a major axis substantially perpendicular to a minor axis, the length of said major axis being greater than the diameter of the corresponding mounting hole in the circuit board and the length of the minor axis being somewhat less than the diameter of the corresponding mounting hole in the circuit board, and a process for securing a contact wire within a plastic connector comprising ultrasonically melting a portion of the plastic in contact with said wire along a portion of the length of said wire and then allowing the plastic to solidify.

11 Claims, 11 Drawing Figures

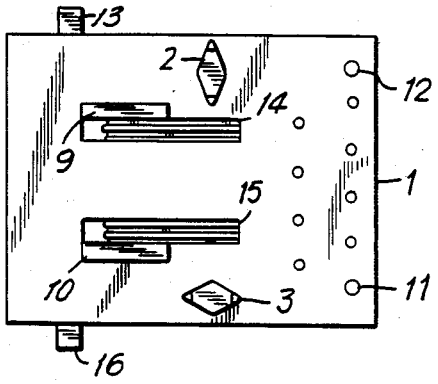
FIG. 1
FIG. 2
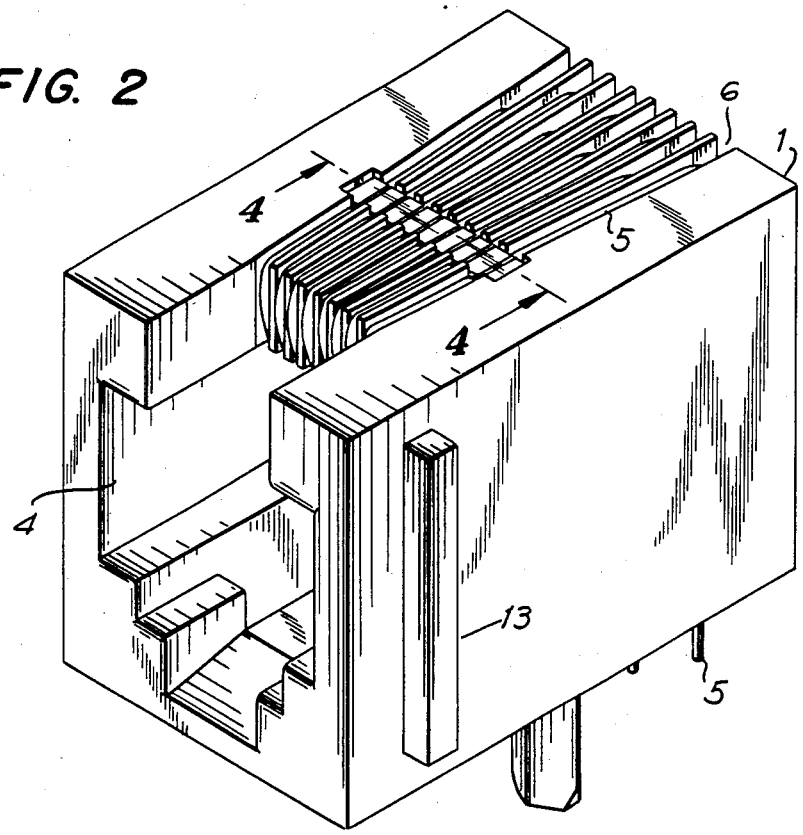
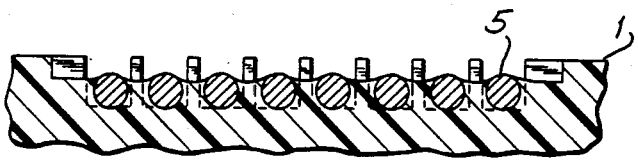
FIG. 4

FIG. 8
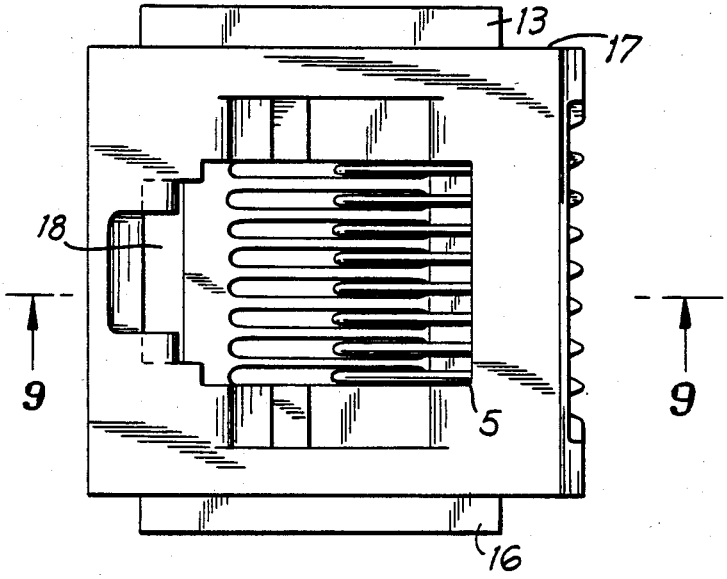
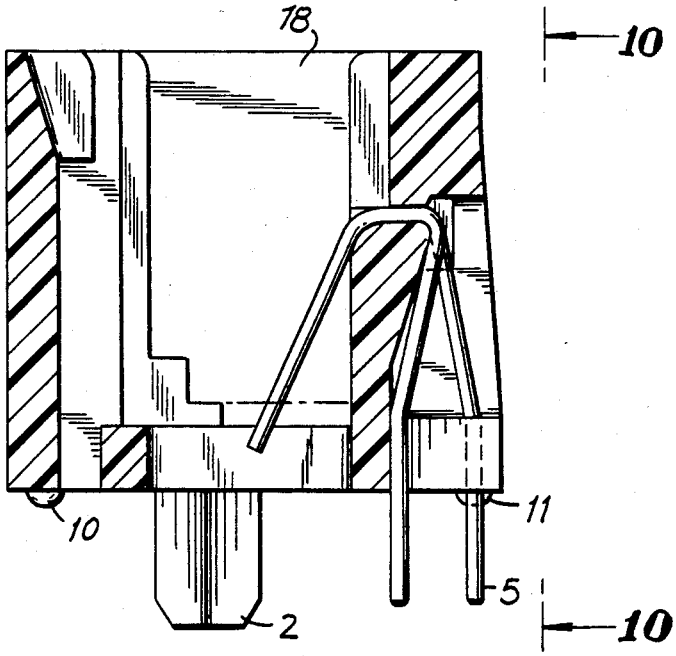
FIG. 9

MODULAR JACK

This application is a continuation of application Ser. No. 828,248 filed Feb. 11, 1986, now abandoned.

This invention relates to electrical connectors which can be mounted on a circuit board, and particularly to improved mounting means for such connectors.

In the manufacture of electronic equipment, it is frequently required that electrical connectors be mounted on a circuit board. Various known mounting methods provide a connector with posts that are intended to fit snugly into holes on a circuit board. However, the known methods do not adequately provide a sturdy, secure and reliable mounting system that properly compensates for slight variations in the diameter of the holes of the circuit board.

The connector of this invention is provided with uniquely shaped projections which are adapted to be fitted into the holes of a circuit board so as to provide a secure and reliable fit. In one of its embodiments, the connector of this invention provides a unique method of making electrical contact with the electrically conductive elements of the circuit board so that there is no need for plated through holes in the circuit board.

The connector of this invention is designed to be mounted on a printed circuit board by means of a unique press fit leg design. The connector has at least two legs which are adapted to fit snugly into corresponding holes on the circuit board. Each leg has a cross section perpendicular to its long axis which is a closed geometric shape having a major axis substantially perpendicular to a minor axis. The major axis is longer than the minor axis. Preferably, the cross section is diamond shaped. The length of the major axis must be greater than the diameter of the corresponding mounting hole in the circuit board. The greater length of the major axis provides for a tight fit when the leg is forced into a hole in the circuit board. Of course, the length should not be so great that the leg cannot be forced into such a hole. Preferably, the length of the major axis is not more than about 5% greater (more preferably, not more than about 2% greater) than the diameter of the hole in the circuit board into which the leg is to be inserted. It is especially preferred that the bottommost portions of each leg be slightly tapered at the ends of the major axis so that each leg may be more readily forced into its corresponding mounting hole. The length of the minor axis is somewhat less than that of the diameter of the hole in the circuit board into which the leg is to be inserted. This allows for misalignment of the hole pattern relative to the leg pattern. Preferably, the length of the minor axis is about 30% smaller (more preferably, about 34% smaller) than the diameter of the hole in the circuit board into which the leg is to be inserted.

The major axis of the first leg may be oriented parallel or perpendicular to the major axis of the second leg. A parallel orientation allows for better alignment of the connector to the hole pattern. The perpendicular orientation, which is preferred, allows for better resistance of the connector to being wiggled loose out of the board.

The connectors of this invention are made in vertical and horizontal entry styles. Both the vertical and horizontal styles use the same press fit leg designs described above. The vertical style receives a modular plug inserted in a direction that is perpendicular to the circuit board on which the connector is mounted. The horizontal style receives a modular plug that is inserted in a direction that is parallel to the plane of the circuit board. Both the vertical and horizontal entry style connectors can be made with varying numbers of contact wires. The most commonly used numbers of contact wires are four, six or eight. The number of contacts and the spacing of these contacts will depend on the desired application.

In one embodiment of the invention, a horizontal entry style connector of the present invention is provided with contacts that engage the surface of the circuit board. Such surface mounting of the contacts eliminates the need for plated through holes in the circuit board. The contact wires have spring characteristics which cause them to press firmly against the circuit board. The terminal portions of the contact wires can be soldered to the board using vapor phase reflow soldering. This is made possible by manufacturing the connector from a high temperature resistant plastic. When a surface mounting arrangement is desired, the contact wires in the connector go through one bend of about 135° and one bend of about 90° within the connector. The contact wires then exit the connector and a short portion at about a 90° angle to the portion of the contact wire that leads out of the connector comes in contact with the circuit board.

In one embodiment of the invention, the body of the connector, which may be a horizontal entry style or a vertical entry style, is made of plastic and the contact wires of the connectors lie within grooves in the connector. Ultrasonic energy may be used to melt a portion of the upper walls of the grooves across the surface of the contact wires so that the wires are held firmly in place. As this procedure reduces the spring characteristics of the contact wires, this is generally not done if surface mounting of the contact wires is desired.

For a more detailed understanding of the invention and for an illustration of preferred embodiments thereof, reference is made to the drawings in which:

FIG. 1 is a bottom plan view of a horizontal entry style modular jack which is a connector of the present invention. The jack has contact wires that fit into plated through holes on a circuit board.

FIG. 2 is a perspective view of the modular jack of FIG. 1.

FIG. 4 is a fragmentary cross sectional view taken along the line 4—4 of FIG. 2.

FIG. 8 is a top plan view of a vertical entry style modular jack of the present invention.

FIG. 9 is a vertical cross sectional view taken along the line 9—9 of FIG. 8.

In the Figures, parts which have the same or a similar function are assigned the same identifying number.

Figure 7:
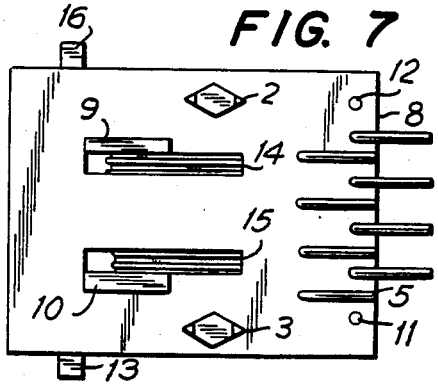
FIG. 7 is a bottom plan view of the modular jack shown in FIG. 6.
Figure 10:
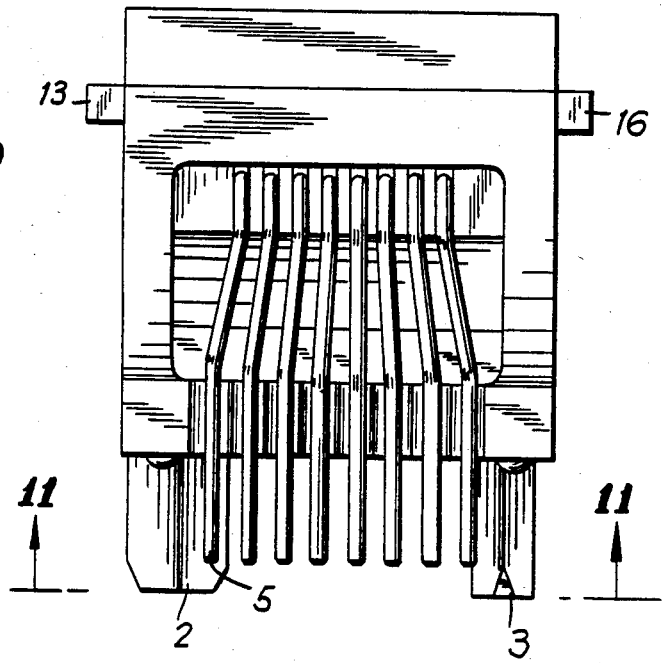
FIG. 10 is a side view of the modular jack of FIG. 8 taken along the lines 10—10 of FIG. 9.
Figure 11:
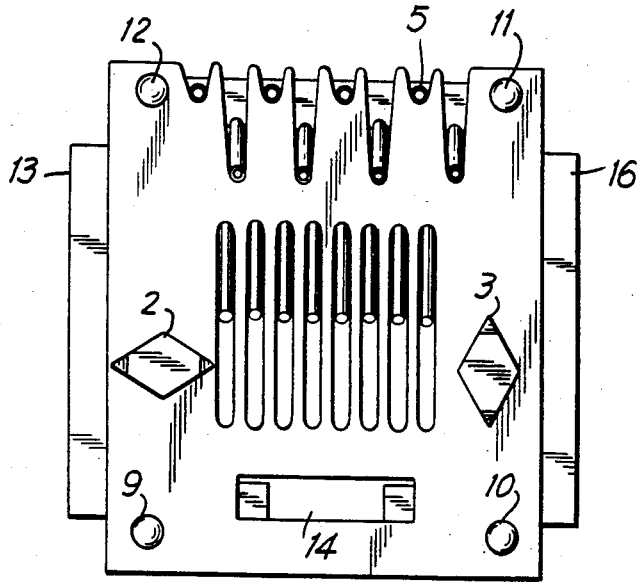
FIG. 11 is a bottom plan view of the modular jack of FIG. 8 taken along the lines 11—11 of FIG. 10.

FIG. 1 shows a horizontal entry modular jack 1 having diamond shaped legs 2 and 3 oriented perpendicular to each other. These diamond shaped legs are oriented so that the major axis of leg 2 is oriented perpendicularly to the major axis of leg 3 and the legs are adapted to be inserted into corresponding circular holes in a circuit board. The bottommost portions of the legs are *tapered at either end of the major axis of each leg*, so that they can more readily be forced into corresponding holes in the circuit board. An alternate orientation of legs 2 and 3 in which the major axis of one leg is oriented parallel to that of the second leg is shown in FIG. 7.

FIG. 2 shows additional features of jack 1. Jack 1 has an aperture 4 into which a modular plug may be inserted. Other features are discussed below.

Figure 3:
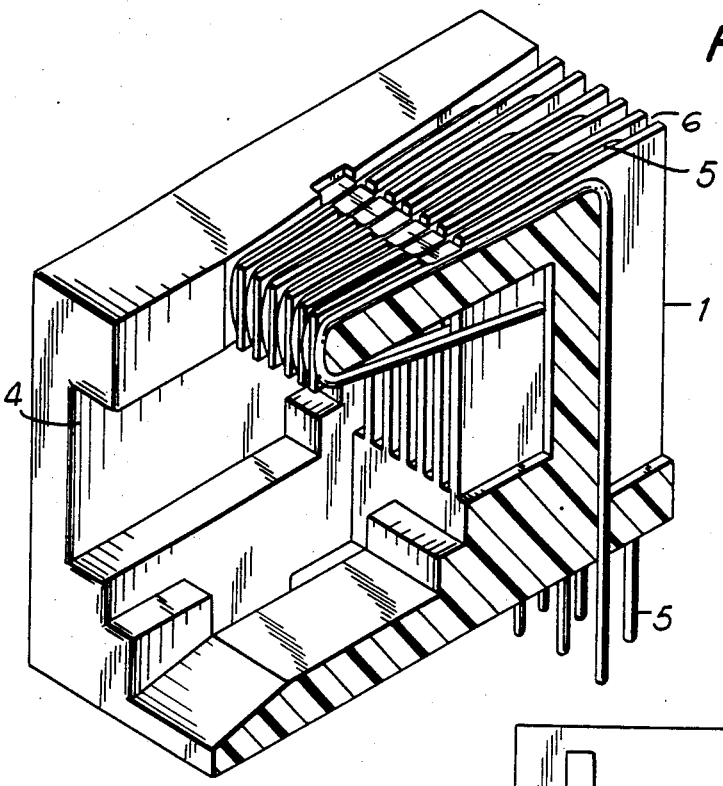
FIG. 3 is a cut-away view of the modular jack shown in FIG. 2.

As shown in FIG. 3, jack 1 has several contact wires, each of which runs within a channel in the jack and has two bends within the jack. For example, contact wire 5 runs in channel 6. Each contact wire is held firmly by being inserted into a hole in the base of the jack.

Figure 6:
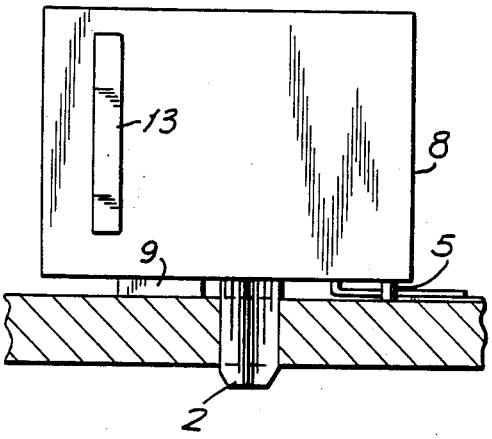
FIG. 6 is a side view of an alternate embodiment of the invention wherein a horizontal entry style modular jack has contact wires intended for surface mounting.
Figure 5:
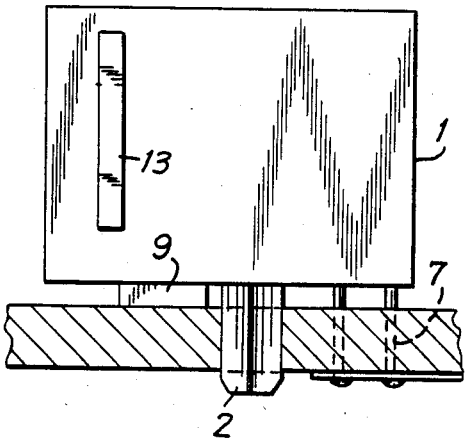
FIG. 5 is a side view showing the modular jack of FIG. 2 affixed to a circuit board.

The contact wires extend downward from the bottom surface of jack 1 and are inserted into plated through holes in a circuit board (see, for example, hole 7 in FIG. 5). Alternately, as shown in FIGS. 6 and 7 for jack 8, the wires are bent at a 90° angle so that the terminal portion of each contact wire is in contact with the top surface of the circuit board.

When the contact wires of the jack are designed to extend directly down into plated holes on a circuit board, the contact wires may be secured more firmly within the grooves of the jack by ultrasonically melting some plastic from the walls of the grooves along a portion of each contact wire and then allowing the plastic to solidify so that each contact wire is held in place by plastic as shown in FIG. 4. This may be done with an apparatus such as an XL ultrasonic assembly system, manufactured by Branson Sonic Power of Danbury, Connecticut.

The modular jacks shown in the Figures also have projections (see, for example, 9, 10, 11, 12, and 16, shown in FIG. 1, and 13 shown in both FIG. 1 and FIG. 2) and apertures (see, for example, 14 and 15 shown in FIG. 1). Projections 9, 10, 11 and 12 serve as standoffs which allow clearance for cleaning the circuit board after the contact wires are soldered to the circuit board. Projections 13 and 16 are mounting ears around which a recess in the user's cabinet can be designed. The recess traps the jack by the use of the ears so the jack is well supported. Apertures 14 and 15 result because tooling in the mold used to form connector 1 protrudes through the bottom of the connector resulting in two voids when the connector is formed. In FIG. 1, the interior of jack 1, including portions of the contact wires, is visible through apertures 14 and 15.

FIGS. 8–11 show a vertical entry modular jack 17. The jack is similar in construction to horizontal entry modular jack 1 described above except that it is designed so that a modular plug may be inserted into the top of the jack (i.e. into aperture 18) rather than into one side of the jack.

While the above description and attached drawings illustrate certain embodiments of the present invention, it will be apparent that other embodiments and modifications may be made that are equivalent thereto and will be obvious to one skilled in the art, and the invention is not to be limited except by the appended claims.

We claim:

1. An electrical connector adapted to be mounted on a circuit board comprising:

an insulating housing;

a plurality of electrical conductors disposed in side-by-side, spaced-apart relationship, said conductors having terminal portions which extend downward from a bottom surface of said housing and are adapted for electrical control to said circuit board; and at least two legs projecting from said bottom surface of the housing, each of said legs being adapted to fit snugly into a corresponding mounting hole on said circuit board, each said leg having a cross section perpendicular to its long axis, said cross section being diamond-shaped having a major axis substantially perpendicular to a minor axis, the length of said major axis being greater than the diameter of the corresponding mounting hole in the circuit board and the length of the minor axis being somewhat less than the diameter of the corresponding mounting hole in the circuit board.

2. The connector of claim 1, wherein the major axis of at least one of said legs is oriented perpendicular to the major axis of another of said legs.

3. The connector of claim 1, wherein the major axis of at least one of said legs is oriented parallel to the major axis of another of said legs.

4. The connector of claim 1, wherein the terminal portions of said conductors are inserted into plated-through holes of said circuit board when the connector is mounted on said board.

5. The connector of claim 1, wherein the insulating housing of said connector is formed of a high temperature resistant plastic and said conductors are soldered to the circuit board by vapor phase reflow soldering.

6. The connector of claim 1, wherein the housing is formed of plastic and has grooves formed along one surface thereof, said conductors extending in said grooves and being secured more firmly therein by ultrasonically melting some of the plastic of said grooves around a portion of said conductors.

7. The connector of claim 1, wherein the conductors are contact wires.

8. The connector of claim 1, wherein the connector is a modular jack and is adapted to receive a modular plug which is inserted in a direction perpendicular to the circuit board.

9. The connector of claim 1, wherein the connector is a modular jack and is adapted to receive a modular plug which is inserted in a direction parallel to the circuit board.

10. The connector of claim 1, wherein the terminal portions of said conductors extend substantially perpendicular to the plane of said bottom surface of the connector housing, and are bent at a 90° angle so that the conductors are adapted to make surface contact with the surface of the circuit board.

11. The connector of claim 10, wherein the bent terminal portions of said conductors are spring-like, enabling them to press firmly aganist said circuit board.

* * * * *

UNITED STATES PATENT AND TRADEMARK OFFICE

CERTIFICATE OF CORRECTION

PATENT NO. : 4,734,043

DATED : March 29, 1988

INVENTOR(S) : Donald R. Emert and John D. Walden

It is certified that error appears in the above-identified patent and that said Letters Patent is hereby corrected as shown below:

Claim 1, column 4, line 11, "control" should read -- contact --.

Signed and Sealed this

Twentieth Day of September, 1988

*Attest:*

DONALD J. QUIGG

*Attesting Officer*

*Commissioner of Patents and Trademarks*